United States Patent [19]

Leaf et al.

[11] 3,999,273

[45] Dec. 28, 1976

[54] INSULATED WIRE SPLICE MACHINE

[75] Inventors: Harry Vincent Leaf, Marshfield; Francis J. Cassidy, Bridgewater, both of Mass.

[73] Assignee: Ark-Les Switch Corporation, Watertown, Mass.

[22] Filed: July 30, 1975

[21] Appl. No.: 600,208

[52] U.S. Cl. ..... 29/203 DT; 29/203 DS; 29/628

[51] Int. Cl.[2] ..... H01R 43/04

[58] Field of Search .... 29/203 D, 203 DT, 203 DS, 29/203 R, 203 P, 628

[56] References Cited

UNITED STATES PATENTS

| | | | |
|---|---|---|---|
| 3,289,284 | 12/1966 | Zent | 29/203 DT |
| 3,329,002 | 7/1967 | Schwalm | 29/203 DT |
| 3,416,212 | 12/1968 | Busler et al. | 29/203 DS |
| 3,537,167 | 11/1970 | Lawson | 29/203 DT |
| 3,857,154 | 12/1974 | Hammond et al. | 29/203 DT |

*Primary Examiner*—Carl E. Hall

[57] ABSTRACT

Apparatus for assembling post insulated wire splices, each assembled splice having first a connector crimped around the wires and next insulation therearound, comprises wire gripper means to retain wires to be spliced in a fixed splice working position, connector forming means for crimping a connector around the wires, and connector feed means to supply a connector to the connector forming means. The connector forming means is movable between a position remote from the splice working position and a crimping position in which the forming means crimps a connector around the wires retained by the wire gripper means in the splice working position. The apparatus further comprises insulation assembly means for assembling insulation around the connector, and insulation feed means to provide insulation to the insulation assembly means. The insulation assembly means is movable between a position remote from the splice working position and an operating position in the splice working position.

10 Claims, 25 Drawing Figures

FIG 2
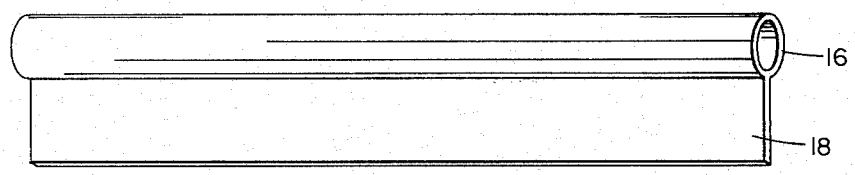
FIG 3
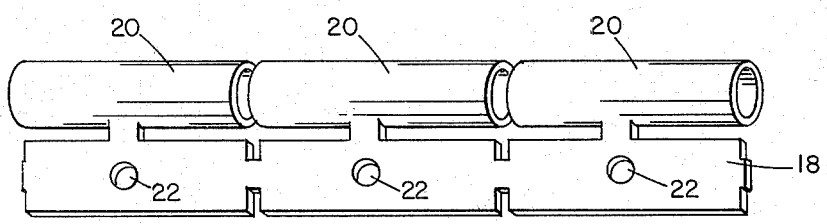
FIG 4
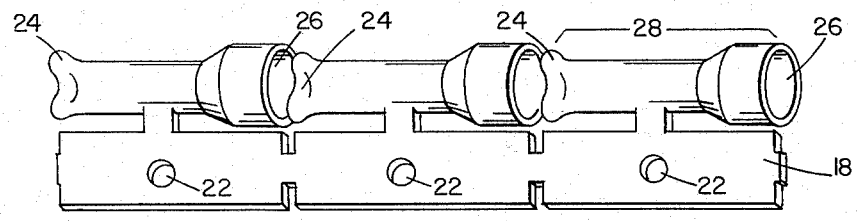
FIG 5
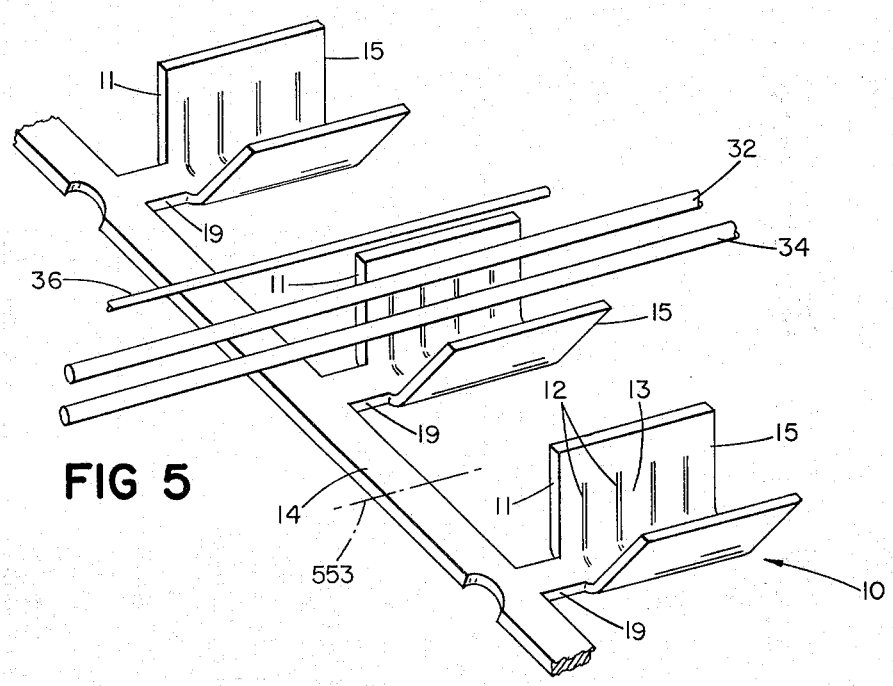
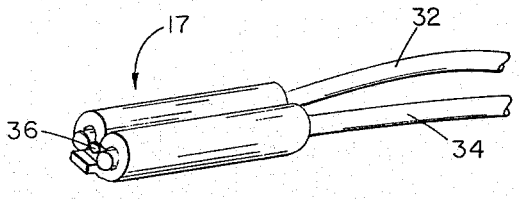
FIG 6
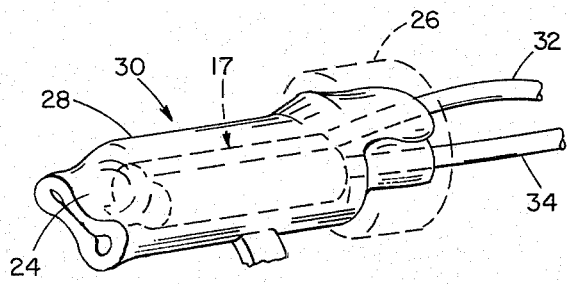
FIG 7

FIG 21
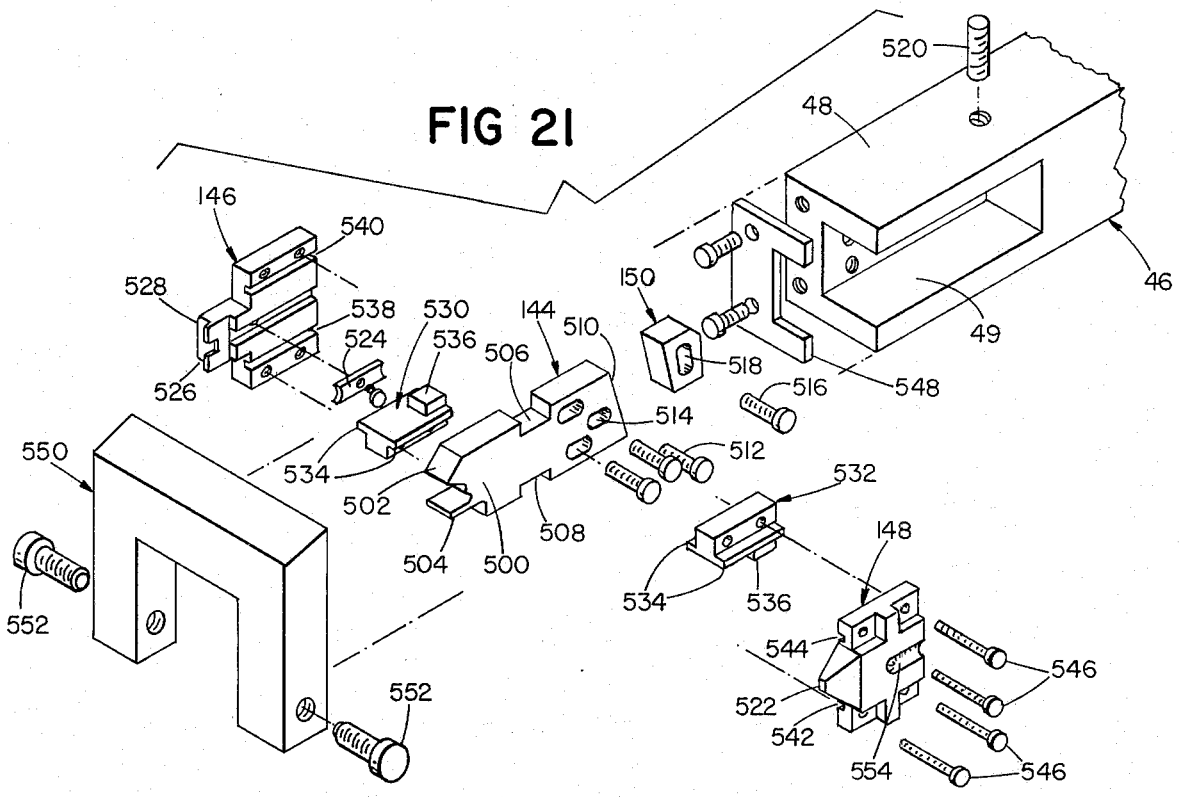
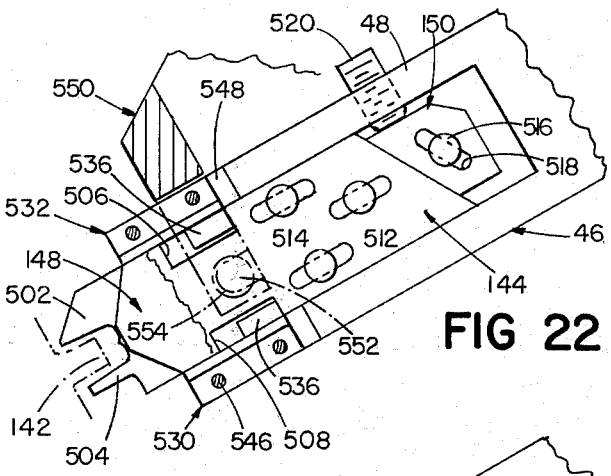
FIG 22
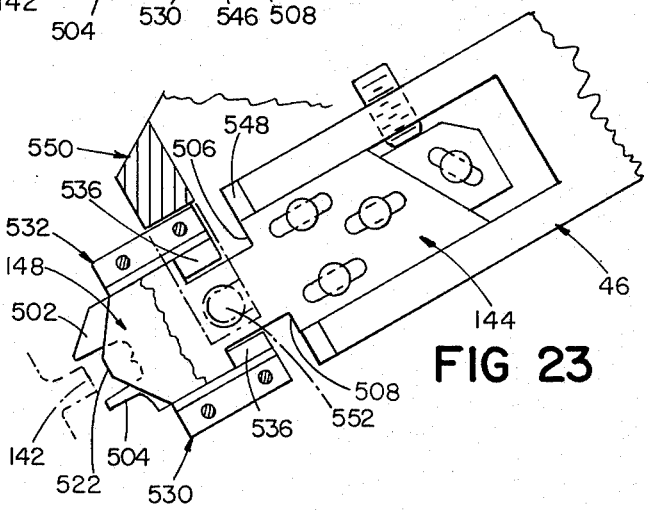
FIG 23
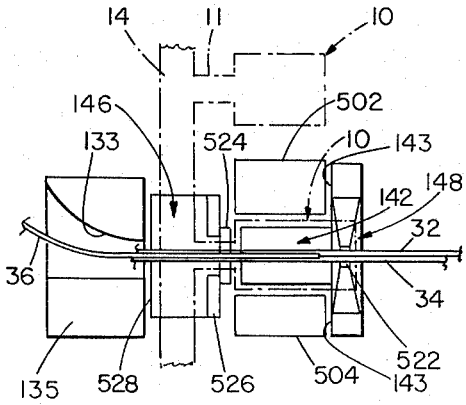
FIG 24

INSULATED WIRE SPLICE MACHINE

This invention relates to apparatus for assembling post insulated wire splices, each assembled splice having first a connector crimped around the wires, and next, insulation formed therearound.

Such insulated wire splices are employed, for example, in preparing stators or other similar workpieces having multiple windings. Such a splice must provide a good electrical connection between the spliced wires, and must be completely insulated from other wires. Both the splice and the insulation must be able to withstand motion and flexing incidental to normal use of the workpiece.

Hitherto, such insulated splices have generally been assembled in two separate operations. In a first operation, the connector is assembled to splice the wires. In a second operation, insulation is assembled around the splice. This second step has generally been accomplished by hand by an operator who winds insulating tape around the splice, or slips an insulating sleeve over the splice. A splice insulated with wound tape has been found to be less satisfactory, as gaps or breaks may appear in the wound insulation during the lifetime of the workpiece. Sleeves slid over the splice are often insufficiently securely attached to the splice and may loosen and be lost during later use of the workpiece.

In addition, either the workpiece (which is generally large and heavy) or the wire leads (which are generally short) must be moved from one working station to another to perform these two operations, and during such transfer the splice is often deformed or damaged.

In some methods previously used, heat-shrinkable insulating sleeves have been assembled by hand to each splice, and the entire workpiece has then been transferred to an oven for shrinking the sleeves. However, heat-shrinkable sleeves are in general less heat-resistant than sleeves of the kind usable in the apparatus of the present invention, and splices using heat-shrinkable sleeves have therefore not been entirely satisfactory. Furthermore, such a method requires added time to complete the splices, and additional labor as well.

It is therefore an object of this invention to provide apparatus for assembling such splices that enables the splice to be formed and insulated without moving either the workpiece or the wires.

It is also an object to provide such apparatus that assembles post insulated splices in a shorter time than has been required hitherto.

It is a further object to provide such apparatus that produces a good electrical connection with a closely fitting seamless insulation therearound.

According to the invention, apparatus to assemble post insulated wire splices comprises wire gripper means to retain wires to be spliced in a fixed splice working position, connector forming means for crimping a connector around the wires, and connector feed means to supply a connector to the connector forming means. The connector forming means is movable between a position remote from the splice working position and a crimping position in which the forming means crimps a connector around the wires retained by the wire gripper means in the splice working position. The apparatus further comprises insulation assembly means for assembling insulation around the connector, and insulation feed means to provide insulation to the insulation assembly means. The insulation assembly means is movable between a position remote from the splice working position and an operating position in the splice working position.

In a preferred embodiment of the apparatus according to the invention, the connector forming means comprises a crimping tool and an anvil cooperating with the crimping tool and carried with the connector feed means. The apparatus further comprises a housing. The insulation assembly means is carried in the housing and comprises an insulation forming tool and a cooperating anvil. Further, the apparatus includes cycle initiate means providing a cycle initiate signal, control means responsive to the cycle initiate signal, and crimping tool reciprocating means, connector feed reciprocating means, housing reciprocating means, and insulation forming tool actuating means, each connected to the control means.

The crimping tool reciprocating means is responsive to the control means to move the crimping tool toward the anvil in the splice working position to crimp a connector around the wires retained by the wire gripper means, and thereafter to remove the crimping tool from the splice working position. The connector feed reciprocating means is responsive to the control means and to the removal of the crimping tool to remove the connector feed means with the anvil from the splice working position.

The housing reciprocating means is responsive to the control means and to removal of the connector feed means with the anvil from the splice working position to move the housing to the splice working position, and the insulation forming tool actuating means is responsive to the control means and to the motion of the housing to the splice working position to actuate the insulation forming tool to assemble insulation around the connector. The housing reciprocating means is responsive to the control means and to the actuation of the forming tool to remove the housing from the splice working position, and the connector feed reciprocating means is further responsive to the control means and to the removal of the insulation assembly means from the splice working position to move the connector feed means with the anvil to the splice working position and to actuate the connector feed means to place a connector in the splice working position for a further cycle.

Other objects, features and advantages will appear from the following description of a preferred embodiment of the invention, taken together with the attached drawings thereof.

BRIEF DESCRIPTION OF THE DRAWINGS

FIGS. 2 and 3 are views of insulating sleeves suitable for use in the machine of FIG. 1, at two preliminary stages of their manufacture;

FIG. 4 shows the insulating sleeves in strip form, as supplied to the machine of FIG. 1;

FIG. 5 shows connectors suitable for use in the machine of FIG. 1;

FIG. 6 is a view of a completed uninsulated splice;

FIG. 7 is a view of the insulated splice;

FIG. 21 is an exploded view of the connector forming tool elements;

FIGS. 22 and 23 show the tool elements of FIG. 21 in two successive positions with respect to the connector and anvil;

FIG. 24 is a diagrammatic plan view of connector-forming elements of FIGS. 13, 22 and 23.

DETAILED DESCRIPTION

Figure 1:
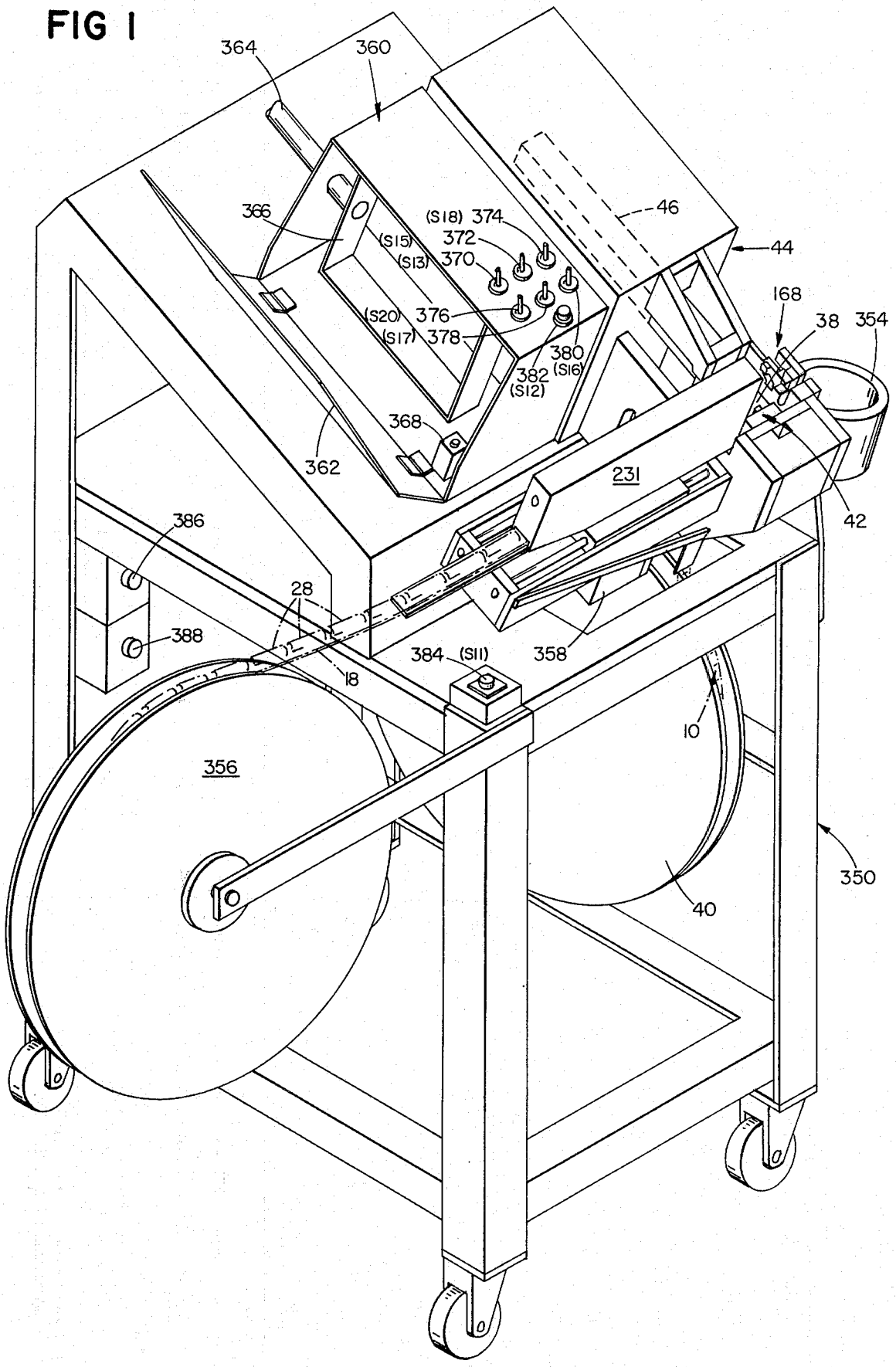
FIG. 1 is a general view of a preferred embodiment of the apparatus of the invention.

Referring now to the drawings, and particularly to FIGS. 2 through 7, insulated splices are formed by the machine described herein, preferably using metal connectors 10 of the type shown in FIG. 5, which are similar to those more particularly described in U.S. Pat. No. 3,735,331, issued May 22, 1973. Each connector 10 comprises a ferrule-forming portion having its inner surface formed with a plurality of grooves 12 with generally flat land surfaces 13 therebetween, at least some of the grooves having a sharp edged undercut side surface for shearing the wire, to expose the bare metal underlying the insulation coating. Other types of connectors may also be used.

Each connector 10 is attached at one end 11 by a neck 19 to a carrier strip 14, and has a free opposite end 15. Wires to be spliced or connected (comprising in most cases, though not invariably, two insulated magnet wires 32 and 34) are laid into the ferrule-forming portion of the connector over free end 15 together with a filler wire 36 if desired; the connector is then crimped over the wires, by means to be described in what follows, causing the groove edges to shear portions of the wires and their insulation to form a good electrical connection. At the same time, the connector is severed at end 11 from the carrier strip, and any portions of the wires extending beyond end 11 of the connector in the direction of the carrier strip are also severed. The assembled uninsulated splice 17 is seen in FIG. 6.

Insulators suitable for use in the machine described herein are preferably initially formed as an extruded seamless tube 16 of suitable high temperature heat stabilized plastic material with an integral attached web 18 (FIG. 2). Individual unformed sleeves 20 are blanked out (FIG. 3) and feed holes 22 are provided in web 18 in the same operation. In a further operation, one end of each sleeve is heat-sealed in a D-form seal as at 24, while the other end is expanded to form a bell mouth 26, providing a formed sleeve 28 (FIG. 4.) The strip of formed insulating sleeves may then be coiled and supplied to the machine.

By means to be described in the following text, formed insulating sleeve 28 is placed over the crimped splice, the expanded bell mouth 26 acting to guide the splice into the sleeve, and the D-seal acting as a stop positively to position the splice within sleeve 28. Heat and pressure are then applied to crimp and close the end 26 of the sleeve over the wires beyond the splice, forming an insulated splice 30 (FIG. 7) having the insulation closely and accurately fitting the splice.

The particular machine described herein employs connectors and insulators that are supplied in strip form, and are severed from the carrier strip only after assembly. However, if preferred, conventional feed mechanisms that accept connectors and insulators in loose piece form may be substituted for the strip feed devices described herein without affecting the operation of the machine.

Referring now particularly to FIG. 1, a particular embodiment of a machine according to the invention is provided to manufacture the products shown in FIGS. 6 and 7.

A frame 350 supports a stator holder 354, in which is placed the workpiece such as a stator whose wires are to be spliced and insulated by the machine. The wires to be spliced are placed by the operator in a splice working position, generally indicated by reference numeral 38, and are retained there by a wire gripper device generally designated 168.

A ram unit 44, to be described in more detail in what follows, includes a ram 46, reciprocable with respect to the splice working position 38, carrying tools to form connector 10 (FIG. 6).

A connector feed unit 42, movable toward and away from the splice working position, feeds connectors supplied in a strip form from reel 40 to an anvil that is movable to be adjacent ram unit 44, as will be described.

An insulator housing unit 231, to be described in more detail in what follows, is reciprocable with respect to the splice working position, and feeds an insulating sleeve 28 in strip form (FIG. 4) from reel 356 to the splice formed by ram unit 44; the insulating sleeve 28 is assembled to the splice 10 by apparatus in housing 231, as will be described.

A stuffer wire box 358 beneath housing unit 231 feeds a stuffer wire, at the operator's option, to the splice 17 as it is formed. The stuffer wire option allows a range of wire sizes to be spliced by the machine without changing the operation of the splice forming mechanism. When wires of large cross section are spliced, no stuffer wire is added; when wires of smaller cross section are spliced, a stuffer wire is added to fill up the cross section of the connector.

Control box 360, whose side cover 362 is shown open, includes a lead-through tube 364 for electrical conductors and a chassis 366 for electrical connections and fuses. A time delay 368, which is located in control box 360, is used in controlling the forming of the insulating sleeve over the splice, as will be described.

There are six toggle switches and a pushbutton switch located on the top of control box 360. Switch 374 (S18) is the ON/OFF switch of the machine. The machine is designed to operate either to form splices 17 without insulation, or to form splices 17 and then insulate them. Switch 372 (S15) selects one of these modes of operation. Pushbutton switch 382 (S12) feeds a filler wire to the splice, at the option of the operator. Switch 380 (S16) is an ON/OFF switch for the heaters in the insulation housing 231, to be described.

The remaining switches 370, 376, and 378 are used in manually cycling through the operation of the machine, while an operator learns to use the machine, and are not relevant to the automatic operation as described herein.

Pushbutton switch 384 at the front of frame 350 activates the ram 46 in ram unit 44 and thereby initiates the cycle of operation of the machine, as will be described.

Two Variac R variable inductors 386 and 388 are supported on frame 350, and control the temperature of the heaters in insulation housing 231, to be described.

Solenoid valves (schematically shown in FIGS. 8 and 9) and other pneumatic fittings are located within frame 350 below ram unit 44 and control box 360, and are not visible in FIG. 1.

Wire Gripper

Figure 13:
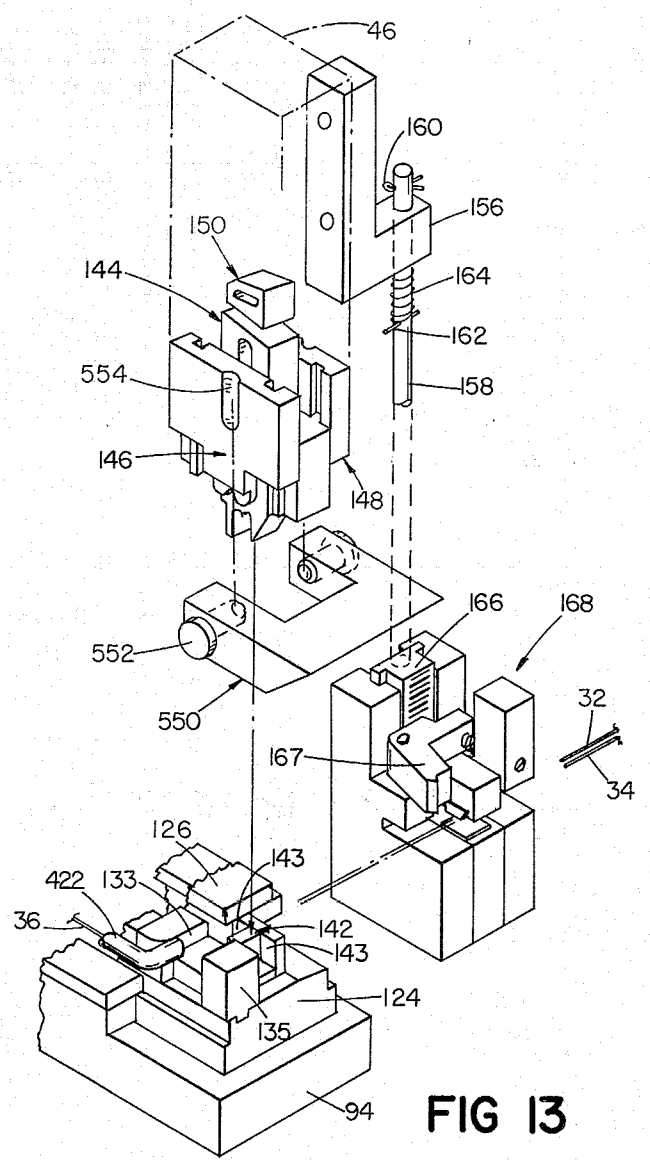
FIG. 13 shows details of the wire gripper and connector forming means.

A wire gripper device, generally designated 168, is secured to frame 350 of the machine between connector feed unit 42 and stator holder 354 (FIG. 1). The gripper 168, seen in more detail in FIG. 13, is actuated during the operation of ram 46. Ram 46 carries a plunger housing 156, adjustably secured to the ram. A plunger 158 is secured within housing 156 by cotter pin 160 and spring retainer 162, and a spring 164 is confined between housing 156 and retainer 162, surrounding plunger 158. Plunger 158 engages portion 166 of wire gripper 168, causing a movable jaw to engage a fixed jaw and to be latched in a closed position, thereby retaining the wires to be spliced in the splice working position, with their further portions laid in an open connector 10.

The wire gripper is not released when ram 46 is retracted, but remains latched until pawl pad 167 is mechanically released by latch 233 on insulation housing 231 (FIG. 19) after the insulating sleeve has been attached. A stuffer or filler wire 36, if desired, is fed to the splice from the opposing direction through tube 422 from stuffer wire box 358 (FIGS. 1 and 20) as will be described.

Ram Unit, Connector Feed and Crimping Tool

Referring now particularly to FIG. 1, the metal connectors 10 in strip form (as seen in FIG. 5) are led from reel 40 upward to a connector feed unit generally indicated at 42, which includes the crimping anvil and feed means. A ram unit, generally indicated at 44, includes a ram 46 carrying crimping and severing tools. Portions of the ram unit and of the connector feed unit, comprising connector forming means, are simultaneously reciprocated toward and away from splice working position 38. When the movable connector forming means are brought together at 38, they cooperate to form the splice. Thereafter the movable portions are retracted to permit insulation housing 231 to be advanced to the splice working position.

Figure 10:
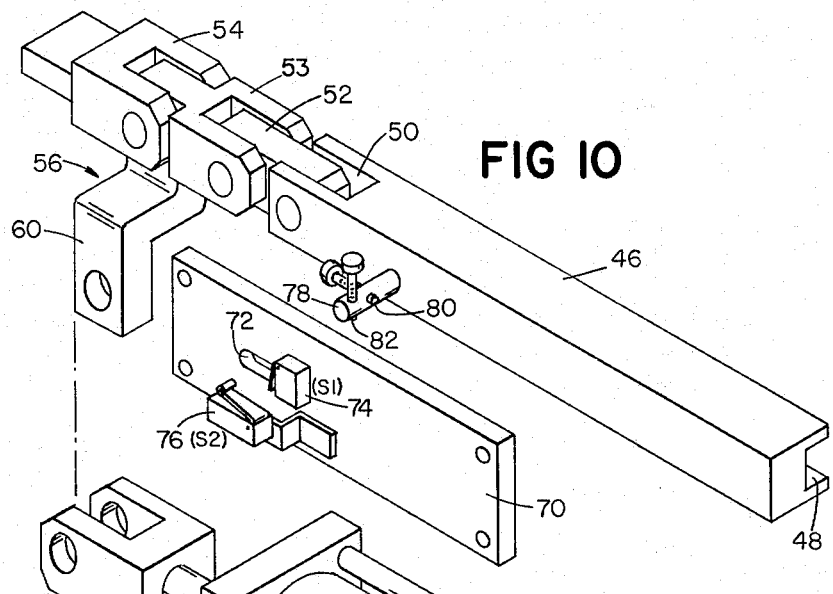
FIG. 10 is an exploded view of part of the connector forming means.
Figure 11:
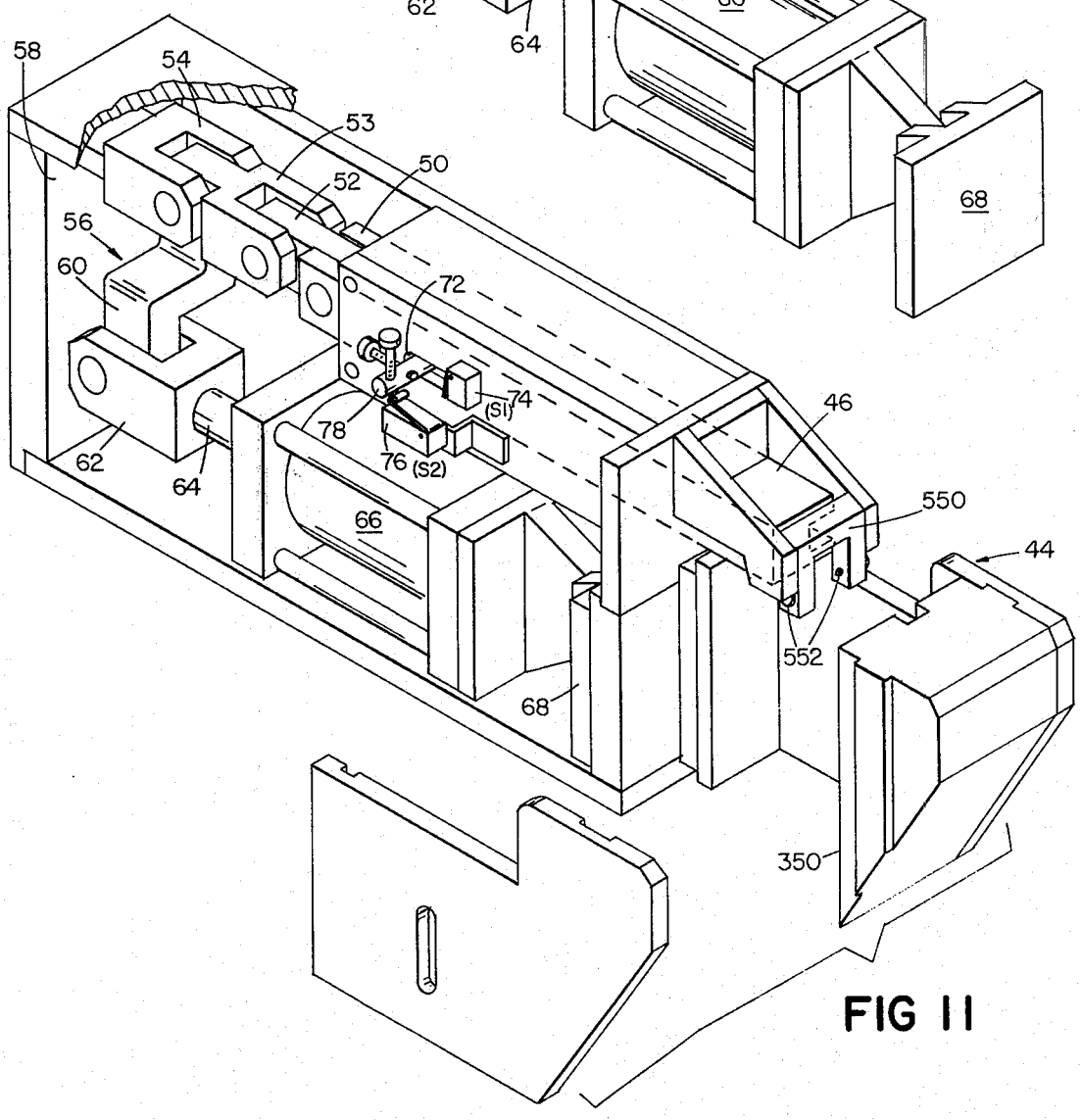
FIG. 11 is a view of the portions of FIG. 10 assembled with other portions of the connector-forming means.

The ram unit is shown in more detail in FIGS. 10 and 11, and comprises generally a ram 46 and an air cylinder 66 to reciprocate the ram toward and away from the splice working position. More in detail, ram 46 provides a tool holding end 48 carrying crimping (connector forming) tools (not shown in FIGS. 10 and 11), and is connected at its opposite end 50 through link 52 to clevis 53 of bell crank 56. Bell crank 56 pivots within clevis 54, which is secured to end plate 58 of ram unit 44. Bell crank arm 60 is received in clevis 62, which is carried on the end of piston rod 64 of air cylinder 66. Air cylinder 66 is pivotable within cylinder base bracket 68.

Ram 46 reciprocates within a ram enclosure having a cover plate 70, providing a ram pin aperture 72. On the outer surface of cover plate 70, adjacent aperture 72, are carried a direct action microswitch 74 (S1) and a one-way trip microswitch 76 (S2). Ram 46 carries on its surface adjacent cover plate 70 a ram pin 78, which provides two microswitch actuators 80 and 82. As seen in FIG. 11, at the bottom of the ram stroke, actuator 80 will close microswitch 74 (S1), which is a return switch, causing air cylinder 66 to reverse and thereby retract ram 46. Actuator 82 trips microswitch 76 (S2) during the retract stroke of ram 46. This switch causes retraction of the movable part of the connector feed means, as will be described further in what follows.

Figure 12:
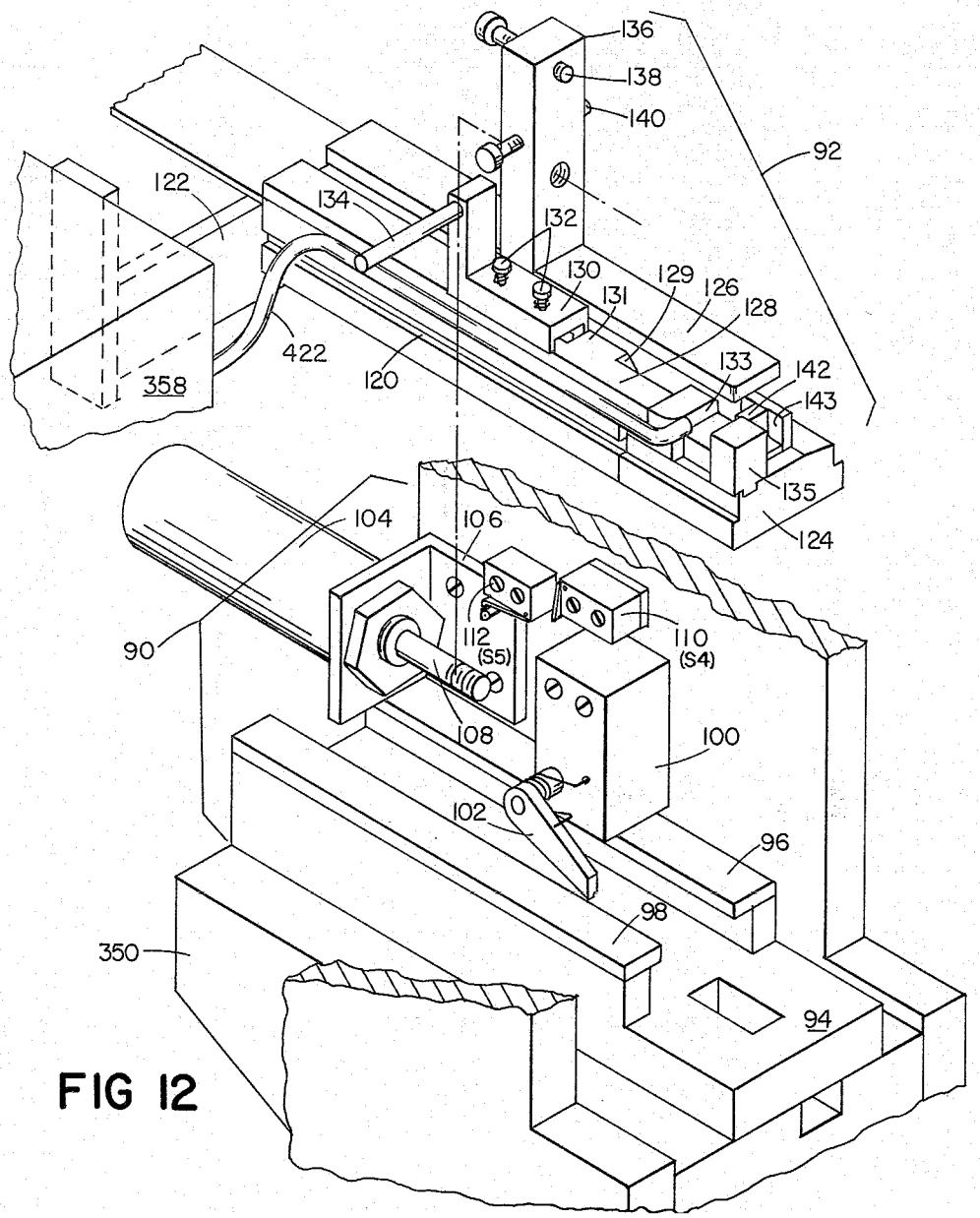
FIG. 12 is an exploded view of the connector feed means.

Referring now to FIG. 12, the connector feed unit generally indicated at 42 in FIG. 1 includes a portion 90 that is fixed to frame 350 of the machine of the invention, and a portion 92 that is slidable within portion 90, toward and away from the splice working position.

Fixed portion 90 provides a slide plate 94, to which are secured two hold down plates 96 and 98. A feed finger block 100 is mounted above hold down plate 96, and provides a feed finger 102. An air cylinder 104 is mounted in bracket 106 with rod 108 extended toward block 100. A direct action microswitch 110 (S4) is mounted above block 100, and a one-way trip microswitch 112 (S5) is mounted above and adjacent to rod 108. The functions of these switches will be described in what follows.

Slidable portion 92 of connector feed unit 42 includes a track 120, having a stop plate 122 secured at one end and a tool holder 124 secured at the opposite (forward) end. Attached to the upper surface of track 120 are a connector guide plate 126 and a connector and feed finger guide 128 including a sloped feed finger guide surface 129 and a flat dwell surface 131 adjacent thereto. A pressure pad 130 is attached by two spring-loading pins 132 to guide 128, and provides a pressure pad pin 134 which is depressed to raise pressure pad 130 when loading a connector strip into feed unit 42. The lower surface of pressure pad 130 (not visible in the drawings) that bears on the connector strip is toothed to engage the strip and permit motion of the strip in one direction only, forward as seen in FIG. 12.

Figure 14:
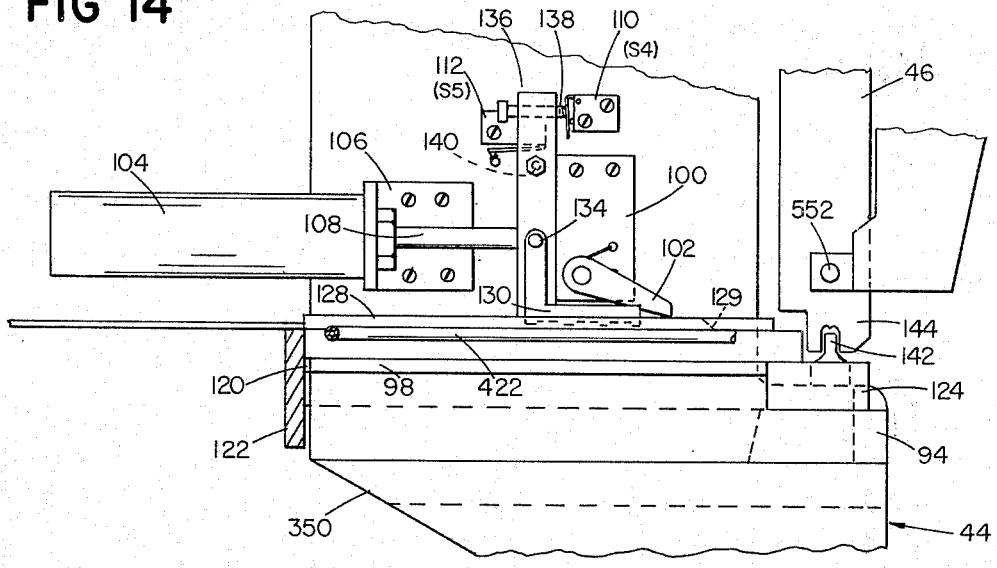
FIGS. 14 and 15 show the connector-forming means and connector feed means at two stages of their operation.
Figure 15:
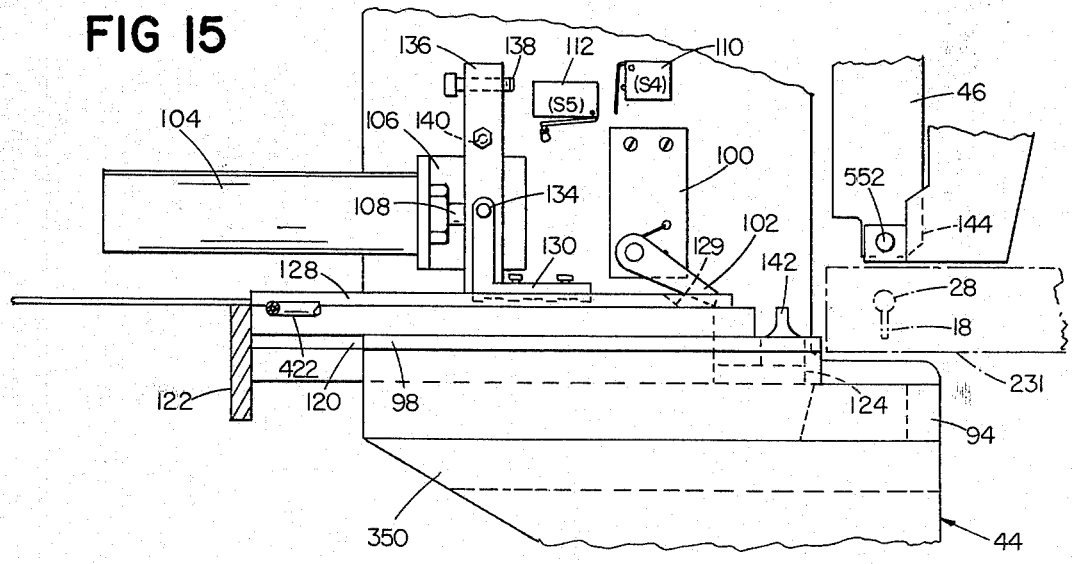

A push rod 136 extends above guide 126, and provides two switch actuators 138 and 140. Piston rod 108 of air cylinder 104 is connected to push rod 136, and causes slidable portion 92 of connector feed unit 42 to reciprocate on slide plate 94 within fixed portion 90. The forward and retracted positions are shown in FIGS. 14 and 15 respectively.

As slidable portion 92 is retracted, after a connector has been crimped, feed finger 102 drops down sloped guide surface 129 to engage a connector, and the strip of connectors is thereby advanced relative to portion 92, to place a leading connector on anvil 142. When portion 92 is advanced at the completion of an operating cycle, feed finger 102 rides up onto flat dwell surface 131; the strip of connectors (including the leading connector) moves with portion 92 and is thereby advanced relative to fixed portion 90, bringing the anvil and the leading connector to the splice working position for the next cycle. Slidable portion 92 travels (relative to fixed portion 90) about 1.5 inch in each direction while the connector strip travels forward relative to portion 92 a distance of about three-quarters of an inch.

In the forward position of slidable portion 92 (FIG. 14), actuator 138 closes microswitch 110 (Switch 4). This is a cutout switch; unless it is closed, the operator cannot initiate operation of the machine by depressing pushbutton switch 384 (FIG. 1). Switch 110 is closed at the end of each operative cycle, since slidable portion 92 moves to its forward position at that time (in response to switch 210, FIG. 17, as will be described) and remains there until another cycle is initiated.

Microswitch 112 (S5) is tripped by actuator 140 during retraction of portion 92. This switch causes the insulation housing 231 to advance, as will be described in more detail in what follows.

The portions of the ram unit 44 and connector feed unit 42 that comprise the connector forming means and are directly operative to form a splice 17 are seen in FIG. 13, together with the wire gripper.

Tool holder 124, at the forward end of slidable portion 92, provides an anvil 142 including tool guide surfaces 143. Tool holder 124 further provides an insert guide block 135 having a curved wire guide surface 133. Stuffer wire feed unit 358 (seen in detail in FIG. 20 and described below) is secured to stop plate 122 (FIG. 12) and reciprocates therewith. Stuffer wire 36, if used, is led through tube 422, which is secured to the guide portion 128. A predetermined length of wire 36 is fed toward anvil 142 by means to be described and is laid over the wires (32 and 34) to be spliced and into the connector 10.

Referring now to FIG. 13, and to FIGS. 21 through 24, the tool holding end 48 of ram 46 (FIG. 10) provides a recess 49. The tools secured to ram 46 comprise generally a crimping tool 144, a cut off tool 146, and an ejector 148.

Crimping tool 144 includes crimping portion 500, comprising two jaws 502 and 504, and further includes two side slots 506 and 508 and a slanted adjustment surface 510. Crimping tool 144 is secured to ram 46 within tool recess 49 by screws 512 through slots 514. An adjustment wedge 150 is also secured within recess 49 by a screw 516 through slot 518. Wedge 150 is moved by set screw 520 in ram tool end 48, and crimping tool 144 is thereby adjusted within recess 49 to adjust the crimp height.

Ejector 148 provides an ejector point 522.

Cut off tool 146 includes a cut off insert 524, and further cutting edges 526 and 528. Two slide tabs 530 and 532 are provided, each having two tongues 534 and a stop 536. Cut off tool 146 provides grooves 538 and 540, and ejector 148 provides grooves 542 and 544. Cut off tool 146 and ejector 148 are secured together, with crimping tool 144 between them, by means of four screws 546. Slide tab 530 is positioned with its tongues 534 in groove 538 of cut off tool 146 and groove 542 of ejector 148, and its stop 536 within side slot 508 of crimping tool 144. Slide tab 532 is similarly positioned on the other side of crimping tool 144.

A resilient pad 548 is secured to the lower surface of ram tool holding end 48. Compression of pad 548 at the bottom of the ram stroke aids in stripping the formed splice from the tools.

The tool package comprising tools 144, 146 and 148 is reciprocated by ram 46 through a nose plate 550 (FIG. 11), which provides two plunger pins (Vlier pins) 552. Tool 148 provides a Vlier pin slot 554 (FIG. 21) and tool 146 provides a similar slot, not visible in the drawing.

In reciprocation of the ram, the entire tool package is moved as a unit downwardly toward anvil 142. The tool package is guided by anvil guide surfaces 143, which engage the flat surface of crimping tool 144, and by insert guide block 135, which engages the outer surface of cut off tool 146. At the bottom of the ram motion, crimping tool 144 crimps the connector 10 over the wires to form a splice. Cut off edge 526 of cut off tool 146 severs the carrier strip 14 at a line indicated at 553 in FIG. 5, and edge 528 severs the filler wire 36. Cut off insert 524 cuts off all three wires 32, 34 and 36 and severs the crimped connector from the carrier strip. Vlier pins 552 enter slots 554.

The free end of anvil 142 is slightly elevated, to provide a formed splice that does not have a downwardly projecting burr or edge. Such an edge would tend to puncture or damage the insulation and thereby shorten the life of the insulated splice.

As ram 46 is retracted (FIG. 23), crimping tool 144 is withdrawn from the formed splice. Vlier pins 552 retain tools 146 and 148 stationary with respect to nose plate 550. While tools 146 and 148 are retarded by the Vlier pins, ejector point 522 bears on connector 10, which is extruded by the crimping operation and extends slightly beyond its original length, as shown in FIG. 24. The ejector point 522 aids in stripping the formed splice from the rolling tool. When slide tab stops 536 are engaged by the lower surfaces of slots 506 and 508, the retract motion of tool 144 overrides the Vlier pins 552 and tools 146 and 148 are retracted.

Insulation Housing and Slide Assembly

Figure 16:
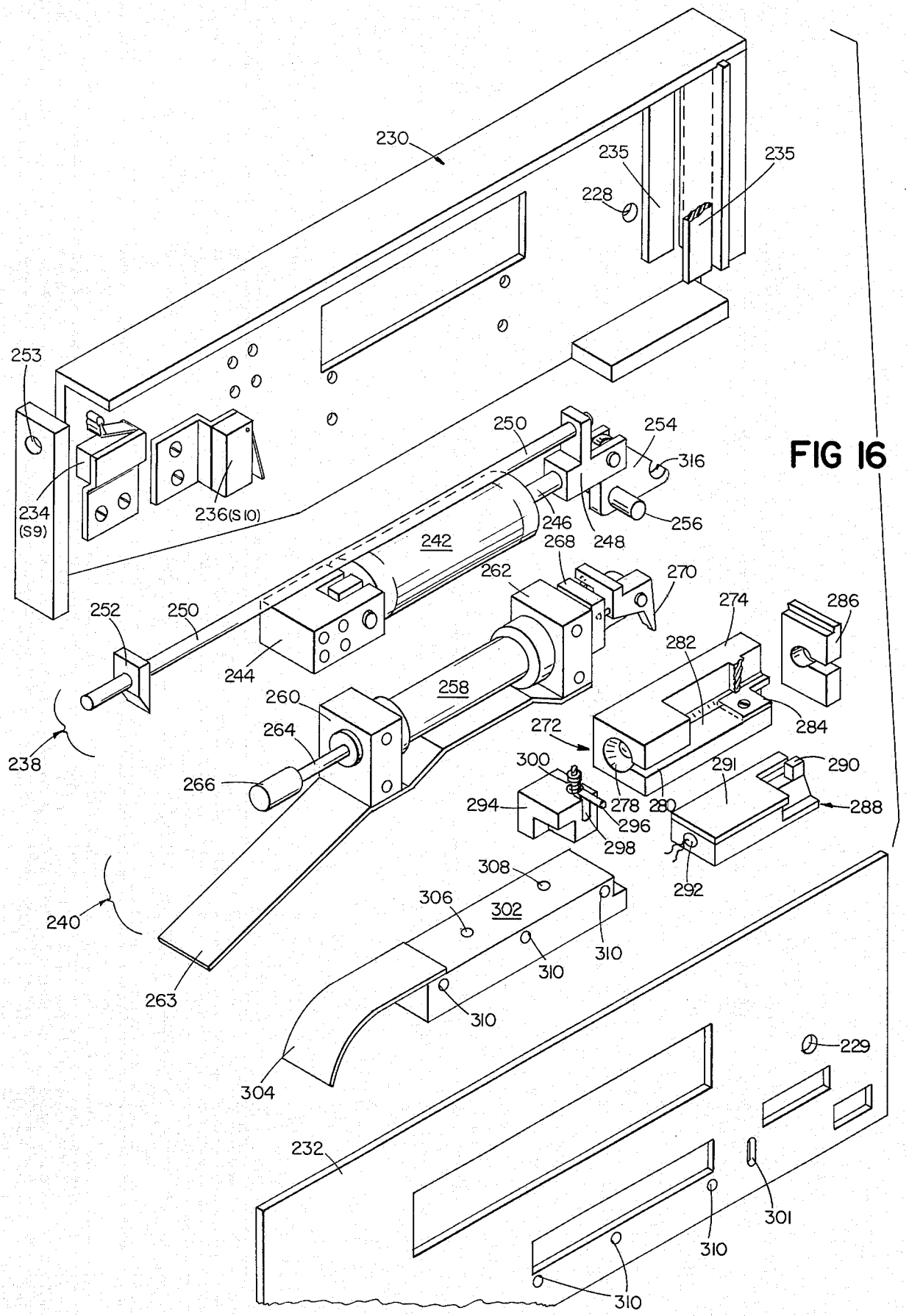
FIG. 16 is an exploded view of the elements of the insulation assembly means.
Figure 18:
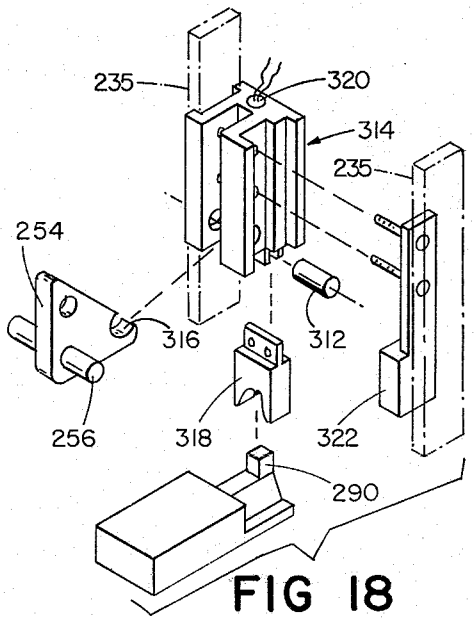
FIG. 18 shows details of the insulation assembling means.
Figure 17:
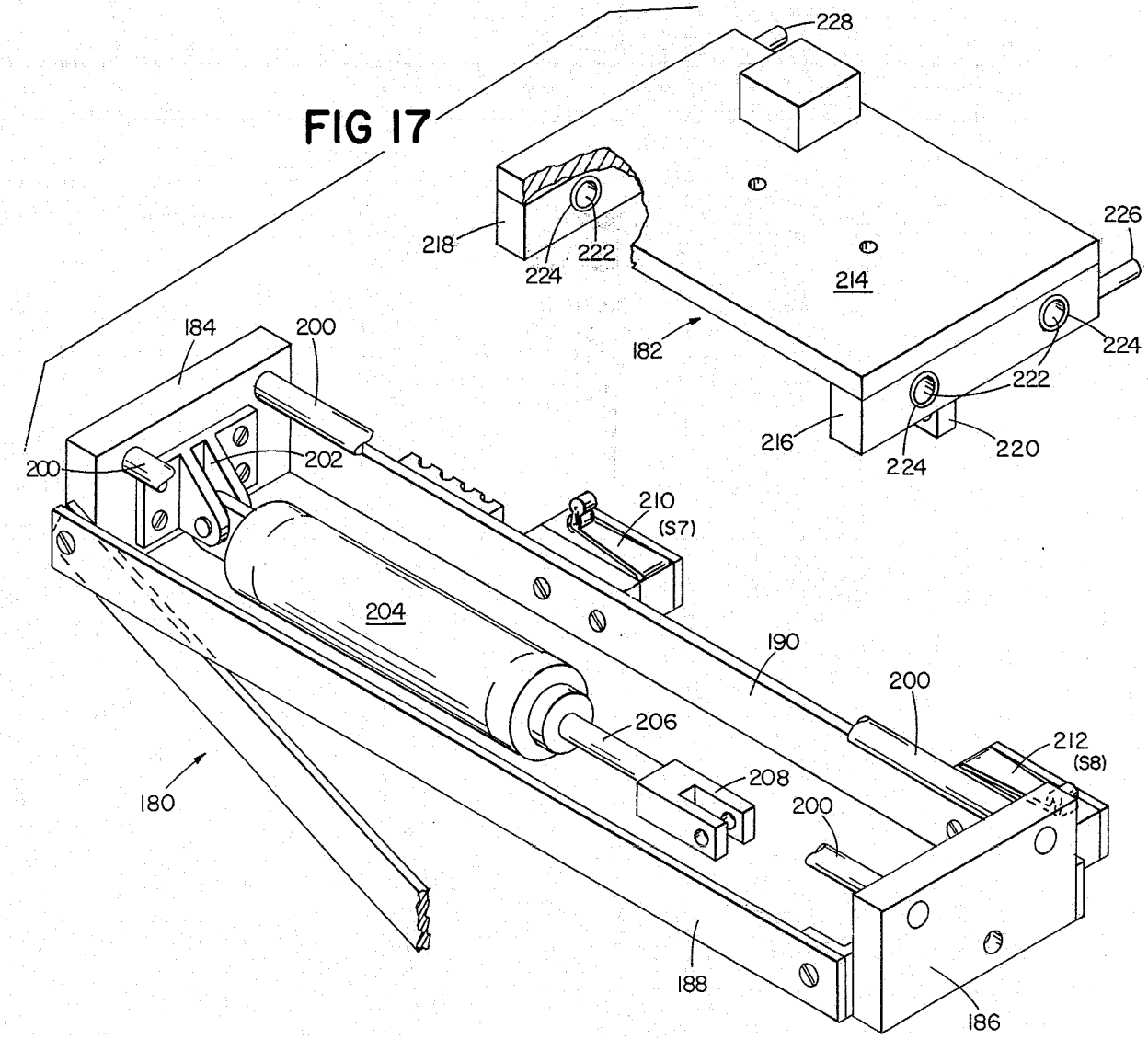
FIG. 17 is an exploded view of the means for moving the insulation assembly means.
Figure 19:
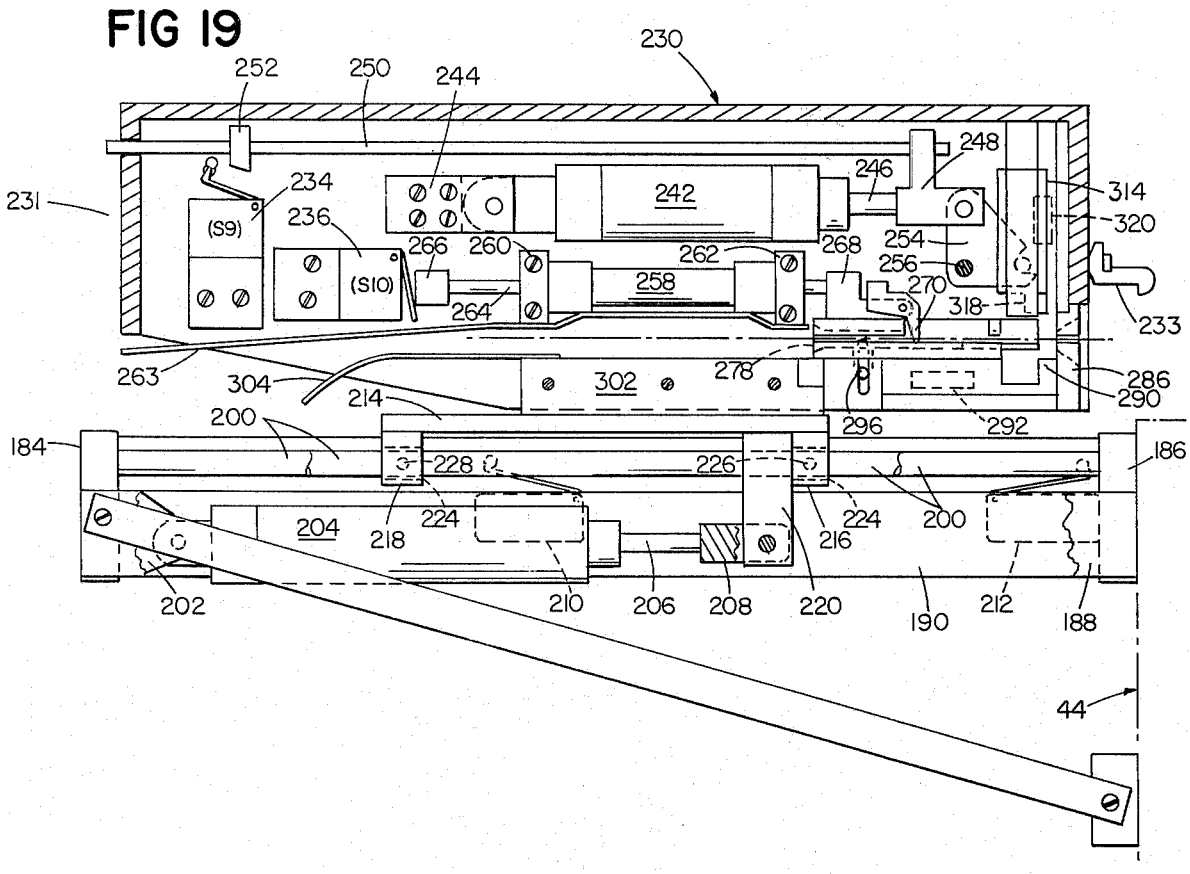
FIG. 19 shows the elements of FIGS. 16–18 in assembled form.

Referring now to FIGS. 16 through 19, the insulation housing 231 is seen in an exploded view in FIG. 16, and the slide assembly on which the housing reciprocates is seen in FIG. 17. Housing 231 is moved toward and away from splice working position 38 (FIG. 1). FIG. 18 shows the elements in housing 231 that form insulating sleeve 28 to splice 17. FIG. 19 shows both units assembled to the frame of the machine of the invention.

The slide assembly (FIG. 17) comprises generally a fixed portion 180 and a reciprocable portion 182 that slides with respect to portion 180.

Fixed portion 180 comprises a frame, including a back plate 184 and a mounting plate 186, connected together by mounting bracket 188 and switch bracket 190 and by two tubular slide pins 200. A pivot bracket 202 is secured to the inner surface of back plate 184, and air cylinder 204 is mounted in bracket 202. Piston rod 206 of cylinder 204 carries a clevis 208. Switch bracket 190 carries two one-way trip microswitches 210 and 212 (S7 and S8) on its outer surface.

Slidable portion 182 of the slide assembly includes a slide plate 214 mounted on two slide blocks 216 and 218. Front slide block 216 provides a depending link block 220 that is received in the clevis 208 of fixed slide assembly portion 180. Each slide block further provides two slide pin holes 222, each having a bearing 224. When assembled (FIG. 19), slidable portion 182 is mounted on fixed portion 180 with slide pins 200 passing through slide pin holes 222. Piston rod 206 of air cylinder 204 moves slide plate 214 by means of link block 220, for reciprocation of the slidable portion of the assembly.

Slide blocks 216 and 218 provide switch actuators 226 and 228 which actuate switches 212 and 210 respectively (on switch bracket 190) during forward and back motions of the slide plate. Switch 212 (S8) actuates the insulation assembling and forming tool 318, in a manner to be described. Switch 210 (S7) actuates the insulating sleeve feed mechanism and the splice feed mechanism, in a manner also to be described.

The insulation housing components (FIG. 16) include a frame 230, which with side cover 232 forms the external portion of the housing 231. A one-way trip microswitch 234 (S9) and a direct action microswitch 236 (S10) are mounted on the inner surface of frame 230. Frame 230 provides, on its leading outer surface, a spring loaded latch lever 233, which disengages wire gripper 168 (FIG. 13) when housing 231 is retracted. Insulation strips 235 also act as guide portions for plunger 314 (FIG. 18).

Within the frame and cover are provided two air cylinder assemblies. The upper air cylinder assembly, generally designated at 238, actuates the insulation assembling and forming tool 318 (FIG. 18), while the lower air cylinder assembly, generally designated at 240, actuates the sleeve feed mechanism.

Upper air cylinder assembly 238 includes air cylinder 242 mounted in cylinder block 244. Piston rod 246 carries a clevis assembly 248, which mounts a switch rod 250 above cylinder 242, carrying a trip block 252 at its end remote from clevis assembly 248. A bellcrank 254 is mounted within clevis assembly 248 and pivots at bellcrank pin 256, which is mounted to frame 230 at pivot hole 228 and to side cover 232 at pivot hole 229. When the housing is assembled, switch rod 238 is mounted in aperture 258 in one end plate of frame 230 and in a similar aperture, not visible, in the opposite end plate. Trip block 252 trips microswitch 234 (S9), when piston rod 246 is retracted; switch 234 activates air cylinder 204 (FIG. 17) to retract the insulation housing 231.

Lower air cylinder assembly 240 includes air cylinder 258, mounted in two cylinder mounts 260 and 262, which carry an upper chute 263. The forward piston rod of air cylinder 258, not visible in the drawing, carries a feed finger block 268 on which is mounted feed finger 270. Cylinder 258 also provides a rear piston rod 264 carrying an adjustable stop 266, which serves as a feed finger stroke adjust. Piston rod 264 closes switch 236 (S10) on the retract stroke of cylinder 258. Switch 236 reverses the air cylinder to provide a forward feed stroke.

A track 272 comprises top and bottom sections 274 and 276, and has a rear funnel opening at 278. A slot 280 is provided between the top and bottom track sections; the web of the strip of insulating sleeves moves through slot 280. Feed finger 270 reciprocates within an open portion 282 in upper track section 274. A removable die plate 284 is provided as an insert into track bottom 276 at the forward end of track 272. A guide plate 286 is provided adjacent the forward end of track 272, to guide the uninsulated splice 17 into the insulating sleeve bell mouth 26.

An anvil assembly 288 includes an anvil 290, a cover plate 291, and a heating element 292, which is inserted into the anvil assembly to heat the anvil. A stop pin block 294, positioned adjacent anvil assembly 288 in the assembled machine, provides a pressure pad pin 296 which is seated in aperture 298 and is biased upwardly by spring 300 through aperture 299 in bottom track section 276 to engage holes 22 in web 18 of the insulating sleeve strip. Pin 296 prevents rearward motion of web 18 but is overridden by the feed finger to move web 18 forward. Side cover 232 provides a pin aperture 301 through which pin 296 protrudes to the exterior of the housing. Pin 296 must be depressed in order to load an insulating sleeve strip into the housing.

A slide block 302 provides a lower chute 304 which cooperates with upper chute 263 on lower cylinder assembly 240 to form a feed path for the insulating sleeve strip before it is fed through track 272. Slide block 302 is secured to slide plate 214 (FIG. 21) by means of two screws, and is secured to frame 230 and side cover 232 of the insulation housing by six screws at 310. The slide block thereby connects the insulation housing to the slide plate for reciprocation of the housing with respect to splice working position 38 (FIG. 1).

Figure 25:
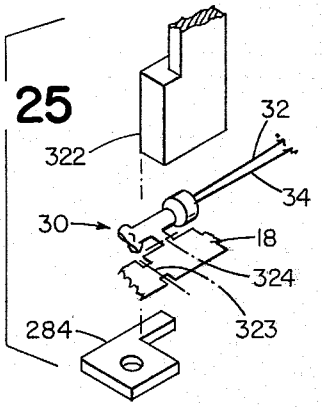
FIG. 25 is a detail of a portion of the insulation assembly means.

Referring now to FIG. 18, the plunger assembly is shown in an exploded view. A pin 312 connects plunger 314 to bellcrank 254, provided in upper air cylinder assembly 238 (FIG. 16). The insulation assembly and forming tool 318 is secured to plunger 314, and is heated by heating element 320 which is inserted into the plunger. A cut off blade 322 is secured to plunger 314 for reciprocation past the insert die plate 284, provided in track 272 (FIGS. 16 and 25). Cut off blade 322 severs web 18 along a line indicated at 323 (FIG. 25), and severs the formed insulator from web 18 along the line indicated at 324.

The assembled insulation housing 231 and the slide assembly are seen in FIG. 19.

Stuffer Wire Feed Unit

Figure 20:
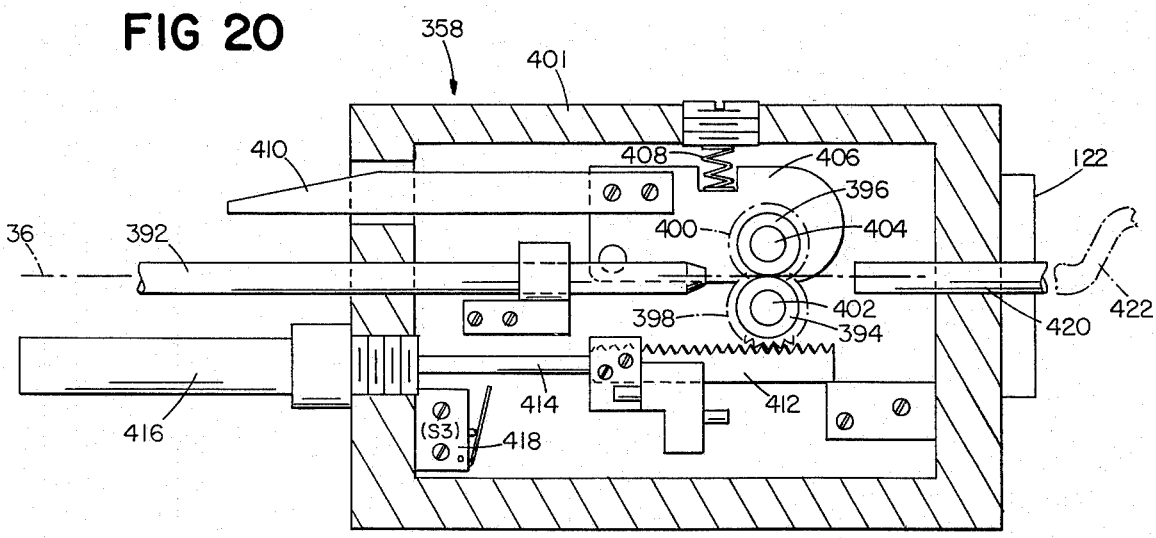
FIG. 20 is a view of the filler wire feed means.

The filler or stuffer wire feed assembly 358 (FIG. 1), which is secured to stop plate 122 of slidable portion 92 of connector feed assembly 42 (FIG. 12) and reciprocates therewith, is seen in detail in FIG. 20. Wire 36 is supplied through a rear feed tube 392 from a source, not shown. Two knurled feed wheels 394 and 396 are keyed to shafts 402 and 404. The upper shaft 404 is mounted in feed wheel arm 406, which is biased downwardly by a spring 408, and may be lifted against the spring by means of lever 410, extending outside the housing 401. Two gears 398 and 400 are mounted on shafts 402 and 404 respectively, and are connected to the feed wheels through one-way roller clutches, not shown.

A rack 412, reciprocated by piston rod 414 of air cylinder 416, engages lower gear 398. As piston rod 414 is retracted, in response to depression of pushbutton switch 382 (FIG. 1), the rack rotates lower gear 398, which engages upper gear 400. The one-way clutches are engaged and the feed wheels are rotated, feeding a length of wire into forward feed tube 420, which communicates with a guide tube 422 whose other end is seen in FIGS. 12 and 13. When the piston rod 414 is fully retracted, rack 412 closes direct-action microswitch 418 (S3), which causes air cylinder 416 to reverse, advancing rack 412. During the forward motion of rack 412, the one-way clutches are disengaged and wheels 394 and 396 remain stationary.

The provision of the stuffer wire option greatly increases the versatility of the apparatus of the invention, because, with its aid, splices can be formed of wires having any of a large range of cross-sectional areas. When wires of small diameter are spliced, a stuffer wire is easily added by use of this feed unit to fill up the cross sectional area of the connector. As a result, the reel of connectors, the connector feed unit, and the crimping tools do not have to be changed in order to form splices of different wires, and the operation of the apparatus is therefore faster and more convenient.

Control System

Figure 8:
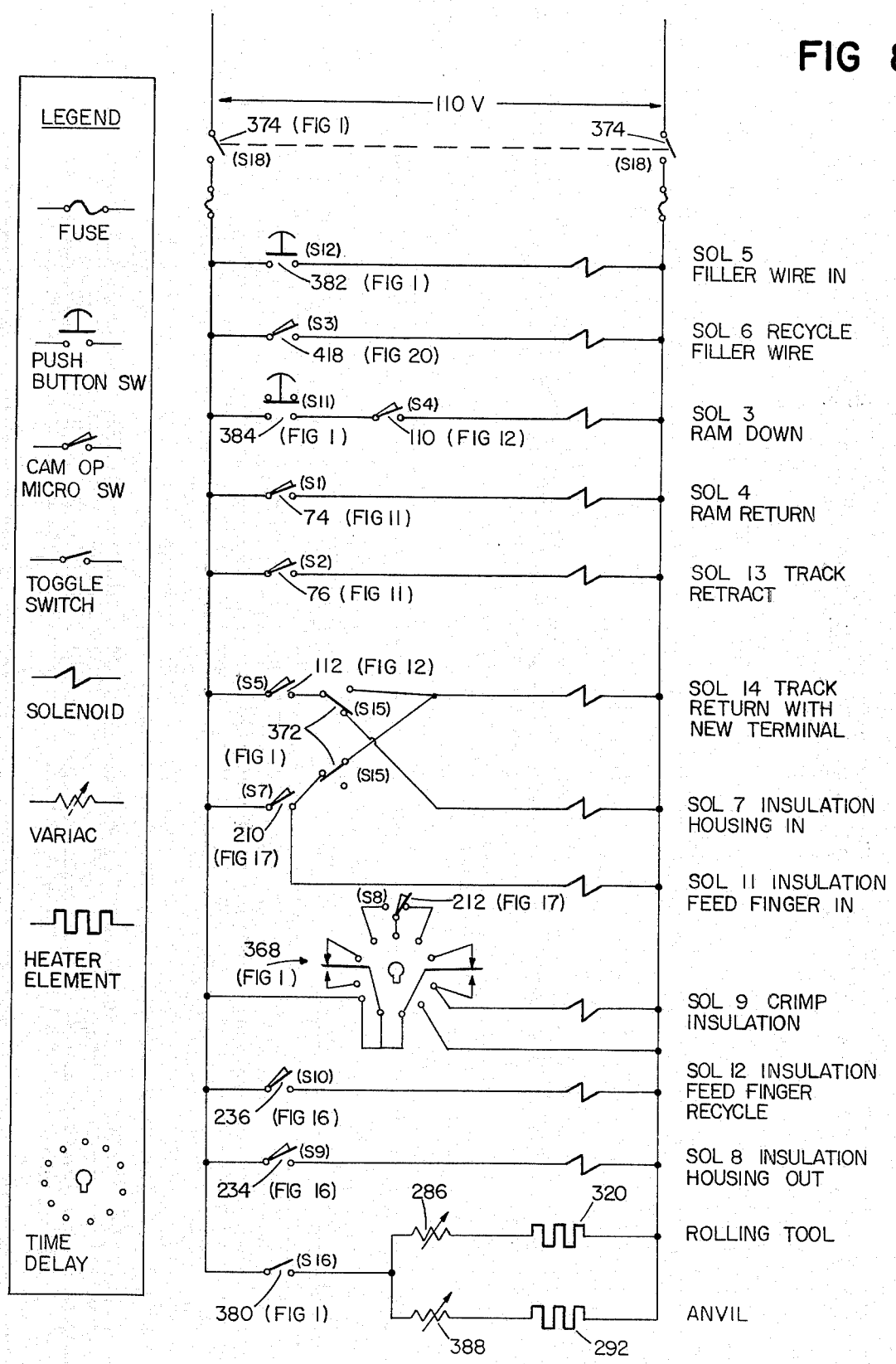
FIG. 8 is a schematic view of the electrical portion of the control means.
Figure 9:
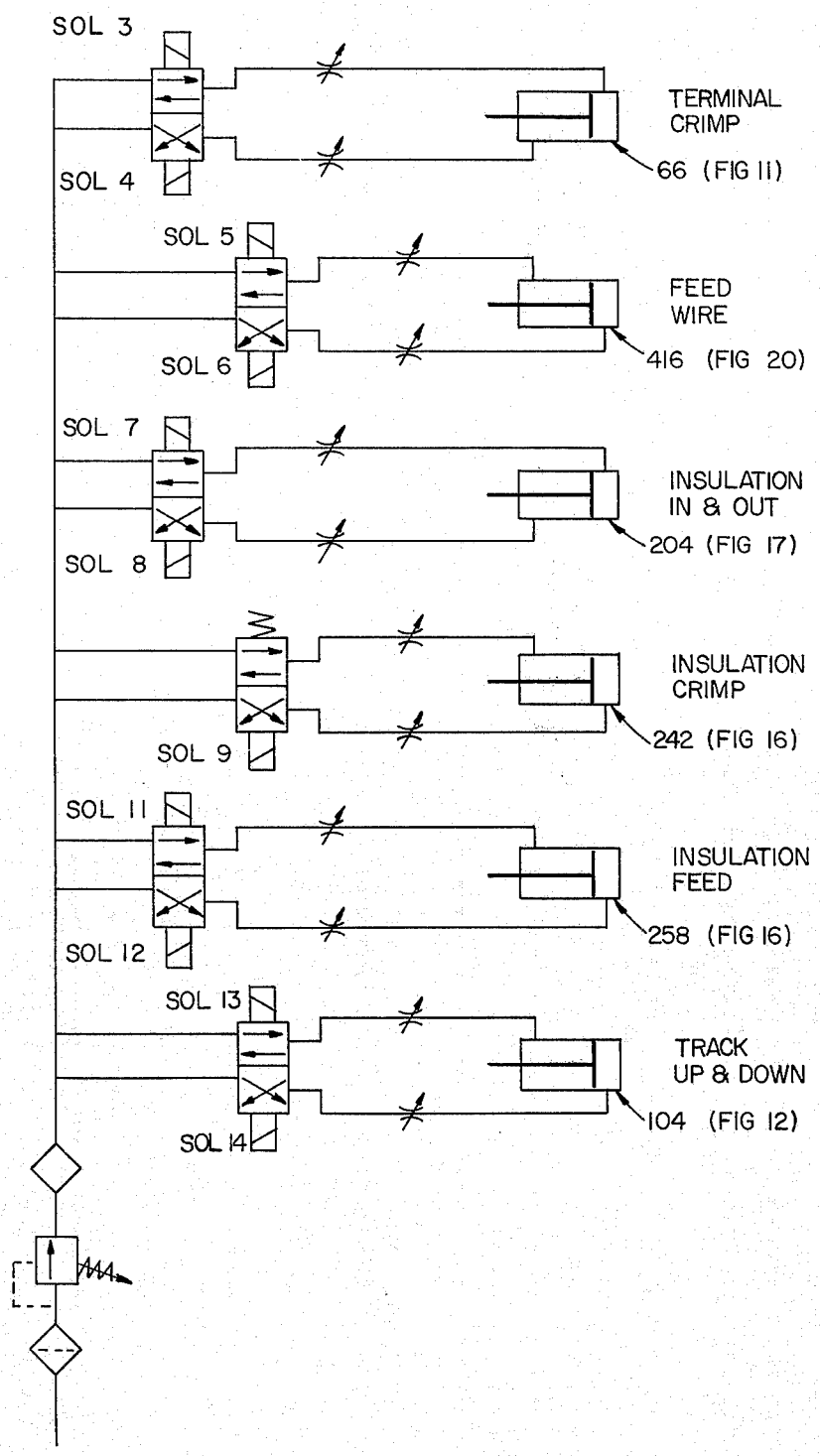
FIG. 9 is a schematic view of the pneumatic portion of the control means.

Referring now to FIGS. 8 and 9, the control mechanism of the machine is shown schematically. FIG. 8 shows the electrical control, and FIG. 9 shows the pneumatic control. Each solenoid, operating a valve to actuate an air cylinder, is shown schematically as a load, together with two heating elements for the insulation rolling tool and anvil.

Pushbutton switch 374 (S18) is the on/off switch for the entire apparatus, as shown in FIG. 1.

OPERATION

In operation, pushbutton switch 382 (S12, FIG. 1) is depressed by the operator when a filler (stuffer) wire is desired in the splice. When this switch is closed, a solenoid (SOL.5) is actuated, which retracts piston rod 414 of air cylinder 416 (FIG. 20), causing the feed assembly to advance a length of filler wire. Switch 418 (S3, FIG. 20) is closed when the air cylinder 416 is completely retracted, and actuates a solenoid (SOL.6) to cause the cylinder to reverse.

For operation, with or without a filler wire, pushbutton switch 384 (S11, FIG. 1) is depressed by the operator to initiate the cycle of operation of the machine. Cut-out switch 110 (S4, FIG. 12) must be closed, as has been discussed, by actuator 138, indicating that the splice feed mechanism is in its forward position and that a connector is in position on anvil 142. Switch 384 actuates a solenoid (SOL.3), which causes air cylinder 66 (FIG. 11) to move ram 46 downward to form the splice. At the bottom of the ram stroke, actuator 80 (FIG. 11) closes microswitch 74 (S1) which actuates a solenoid (SOL. 4) to retract the ram from the splice working position. Microswitch 76 (S2, FIG. 11) is tripped by actuator 82 during the retract stroke of the ram, and actuates a solenoid (SOL.13), which causes air cylinder 104 (FIG. 12) to retract slidable portion 92 of the connector feed means from the splice working position.

Microswitch 112 (S5, FIG. 12) is tripped by actuator 140 during retraction of slidable portion 92. If toggle switch 372 (S15, FIG. 1) is set in the "insulated" position, microswitch 112 actuates a solenoid (SOL. 7), controlling air cylinder 204 (FIG. 17), which advances insulation housing 231 toward the splice working position. If toggle switch 372 is set in the "non-insulated" position, microswitch 112 actuates a solenoid (SOL.14) to cause air cylinder 104 (FIG. 12) to advance, feeding a new connector and closing switch 110 (S4).

Microswitch 212 (S8, FIG. 17) is closed by actuator 226 during the forward motion of the insulation housing, and actuates a solenoid (SOL.9) through time delay 368 (FIG. 1). That solenoid (SOL. 9) causes air cylinder 242 to advance, thereby moving plunger 314 to form the insulation around the splice. The length of time during which heat and pressure are applied is determined by the setting of time delay 368, and the air cylinder automatically returns at the expiration of the time. During this retract stroke of air cylinder 242, trip block 252 trips microswitch 234 (S9), which actuates a solenoid (SOL. 8) to cause air cylinder 204 to retract the insulation housing 231 from the splice working position.

During the retraction of the insulation housing, actuator 228 closes switch 210 (S7, FIG. 17), which acutates the solenoid (SOL.14) to cause air cylinder 104 (FIG. 12) to advance the slidable portion 92 of the connector feed assembly 42, thereby to feed a connector for the next cycle.

Microswitch 210 (S7) also actuates a solenoid (SOL.11) to cause air cylinder 258 in the insulation housing (FIG. 16) to retract. At the end of the retract stroke, microswitch 236 (S10, FIG. 16) is closed by stop 266 on piston rod 264 of air cylinder 258, actuating a solenoid (SOL. 12) to reverse the air cylinder and provide a feed stroke.

Toggle switch 380 (S16, FIG. 1) is the on/off switch for the heaters 320 and 292 (FIGS. 16 and 18); the temperatures of the heaters are controlled by Variac R variable inductors 386 and 388 (FIG. 1).

We claim:

1. Apparatus for assembling post insulated wire splices, each assembled splice having first a connector crimped around the wires and next insulation thereround, comprising wire gripper means for retaining wires to be spliced in a fixed splice working position, connector forming means for crimping a connector around said wires, connector feed means for supplying a connector to said connector forming means, means for moving said connector forming means between a position remote from said splice working position and a crimping position in which said forming means crimps a connector around the wires retained by said wire gripper means in said splice working position, insulation assembly means for assembling insulation around said connector, insulation feed means for providing insulation to said insulation assembly means, and means for moving said insulation assembly means between a position remote from said splice working position and an operating position in which said insulation assembly means assembles insulation around said connector while said connector is in said splice working position, and means for automatically controlling movements of said connector forming means and said insulation assembly means to and from said splice working position.

2. The apparatus of claim 1, said insulation assembly means comprising an insulation forming tool and a cooperating anvil, said apparatus further including a housing, said insulation forming tool and cooperating anvil being carried in said housing, said means for moving said insulation assembly means comprising housing reciprocating means responsive to removal of said connector forming means from said crimping position to move said housing to said operating position, said apparatus further including insulation forming tool actuating means responsive to the motion of said housing to said operating position to actuate said insulation forming tool and said anvil to assemble insulation around said connector, said housing reciprocating means being responsive to the actuation of said forming tool and anvil to remove said housing from said operating position.

3. The apparatus of claim 1, said connector forming means comprising
a crimping tool, and
an anvil cooperating with said crimping tool and carried with said connector feed means, said apparatus further including connector feed reciprocating means, said means for moving said connector forming means including tool reciprocating means for moving said crimping tool toward said anvil into said crimping position to crimp a connector around said wires, and thereafter removing said crimping tool from said crimping position, said connector feed reciprocating means being responsive to the removal of said crimping tool to remove said connector feed means with said anvil from said crimping position, and being further responsive to the removal of said insulation assembly means from said operating position to move said connector feed means with said anvil to said crimping position and to actuate said connector feed means to place a connector on said anvil for a further cycle.

4. The apparatus of claim 1, further including control means for
actuating said connector forming means to crimp a connector around said wires, then causing said means for moving said connector forming means to remove said connector forming means to its said remote position, and thereafter causing said means for moving said insulation assembly means to move said insulation assembly means from its said remote position to its said operating position to assemble insulation around said crimped connector.

5. The apparatus of claim 4, further including cycle initiate means providing a cycle initiate signal, said control means being responsive to said cycle initiate signal to actuate said connector forming means and then to cause said means for moving said connector forming means to remove said connector forming means as said, thereafter to cause said means for moving said insulation assembly means to move said insulation assembly means from its said remote position to its said operating position to assemble insulation around said crimped connector, and then to remove said insulation assembly means to its said removed position, said control means thereafter actuating said connector feed means to feed a connector and causing said means for moving said connector forming means to move said connector forming means with a connector to said crimping position for a further cycle.

6. The apparatus of claim 5, said connector forming means comprising
a crimping tool, and
an anvil cooperating with said crimping tool and carried with said connector feed means, said means for moving said connector forming means further including
tool reciprocating means and connector feed reciprocating means connected to said control means, said tool reciprocating means being responsive to said control means to move said crimping tool toward said anvil in said crimping position to crimp a connector around said wires, and thereafter to remove said crimping tool from said crimping position, said connector feed reciprocating means being responsive to said control means and to the removal of said crimping tool to remove said connector feed means with said anvil from said crimping position, and being further responsive to said control means and to the removal of said insulation assembly means from its said operating position to move said connector feed means with said anvil to said crimping position and to actuate said connector feed means to place a connector on said anvil for a further cycle.

7. The apparatus of claim 5, said insulation assembly means comprising
an insulation forming tool and a cooperating anvil,
said apparatus further including
a housing, said insulation forming tool and cooperating anvil being carried in said housing,
said means for moving said insulation assembly means including
housing reciprocating means responsive to said control means and to removal of said connector forming means from said crimping position to move said housing to its said operating position,
said apparatus further including
insulation forming tool actuating means responsive to said control means and to the motion of said housing to said operating position to actuate said insulation forming tool to assemble insulation around said connector,
said housing reciprocating means being responsive to said control means and to the actuation of said forming tool to remove said housing from said operating position.

8. Apparatus for assembling post insulated wire splices, each assembled splice having first a connector crimped around the wires and next insulation therearound, comprising
wire gripper means for retaining wires to be spliced in a fixed splice working position,
connector forming means for crimping a connector around said wires,
connector feed means for supplying a connector to said connector forming means,
said connector forming means comprising
a crimping tool and
an anvil cooperating with said crimping tool and carried with said connector feed means,
a housing,
insulation assembly means carried in said housing and comprising
an insulation forming tool and
a cooperating anvil,
insulation feed means for providing insulation to said insulation assembly means,
cycle initiate means providing a cycle initiate signal,
control means responsive to said cycle initiate signal, and
crimping tool reciprocating means, connector feed reciprocating means, housing reciprocating means, and insulation forming tool actuating means, each connected to said control means,
said crimping tool reciprocating means being responsive to said control means to move said crimping tool toward said anvil into said crimping position to crimp a connector around said wires retained by said wire gripper means in said splice working position, and thereafter to remove said crimping tool from said crimping position, said connector feed reciprocating means being responsive to said control means and to the removal of said crimping tool to remove said connector feed means with said anvil from said crimping position, said housing reciprocating means being responsive to said control means and to removal of said connector feed means with said anvil from said crimping position to move said housing to an operating position, said insulation forming tool actuation means being responsive to said control means and to the motion of said housing to said operating position to actuate said insulation forming tool to assemble insulation around said connector, said housing reciprocating means being responsive to said control means and to the actuation of said forming tool to remove said housing from said operating position, said connector feed reciprocating means being further responsive to said control means and to the removal of said insulation assembly means from said operating position to move said connector feed means with said anvil to said crimping position and to actuate said connector feed means to place a connector in said crimping position for a further cycle.

9. The apparatus of claim 8, said tool reciprocating means further providing wire gripper engaging means, actuated during motion of said connector forming means to said crimping position, and said housing further providing wire gripper release means actuated during removal of said housing from said operating position to release said wires with said assembled splice.

10. The apparatus of claim 8, further including a filler wire unit carried on said connector feed means and reciprocable therewith, including filler wire feed means and guide tube means having an end adjacent said anvil, said filler wire unit being selectively operable to place a length of filler wire in said splice working position with said wires to be spliced.

* * * * *